United States Patent [19]

Stahlecker et al.

[11] Patent Number: 4,854,119

[45] Date of Patent: Aug. 8, 1989

[54] ARRANGEMENT FOR OPEN-END ROTOR SPINNING

[75] Inventors: Fritz Stahlecker, Bad Überkingen; Hans Stahlecker, Süssen; Wolfgang Feuchter, Deggingen-Reichenbach, all of Fed. Rep. of Germany

[73] Assignees: Fritz Stahlecker; Hans Stahlecker, both of Fed. Rep. of Germany

[21] Appl. No.: 153,443

[22] Filed: Feb. 8, 1988

[30] Foreign Application Priority Data

Feb. 19, 1987 [DE] Fed. Rep. of Germany ..... 3705318
Sep. 3, 1987 [DE] Fed. Rep. of Germany ..... 3729425

[51] Int. Cl.[4] ..... D01H 7/882; D01H 1/135

[52] U.S. Cl. ..... 57/417; 57/406; 57/415

[58] Field of Search ..... 57/404, 406, 407, 411, 57/413, 417

[56] References Cited

U.S. PATENT DOCUMENTS 4,110,961 9/1978 Havel et al. ..... 57/417
4,712,369 12/1987 Vernon ..... 57/417
4,773,211 9/1988 Stahlecker et al. ..... 57/417

FOREIGN PATENT DOCUMENTS 2455528 5/1976 Fed. Rep. of Germany .
2745195 4/1978 Fed. Rep. of Germany .

*Primary Examiner*—John Petrakes
*Attorney, Agent, or Firm*—Barnes & Thornburg

[57] ABSTRACT

An open-end rotor spinning apparatus is provided which includes a spinning rotor element for forming yarn including an open side. A cover element is provided for covering the open side of the spinning rotor element. A projection element is disposed at the cover element and projects into the side of the spinning rotor element. A fiber feeding duct is disposed in the projection element. A yarn withdrawal duct is also disposed in the projection element and provides a pathway for formed yarn being withdrawn from the spinning rotor element. A yarn withdrawal nozzle element projects from the yarn withdrawal duct element into the spinning rotor element open side. Holding elements are provided other than the yarn withdrawal duct element which hold the yarn withdrawal nozzle element on the projection element.

33 Claims, 6 Drawing Sheets

FIG.6
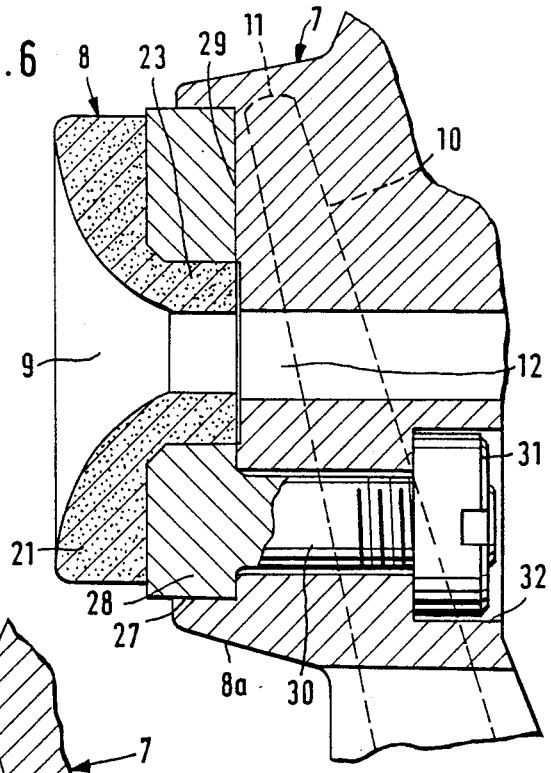
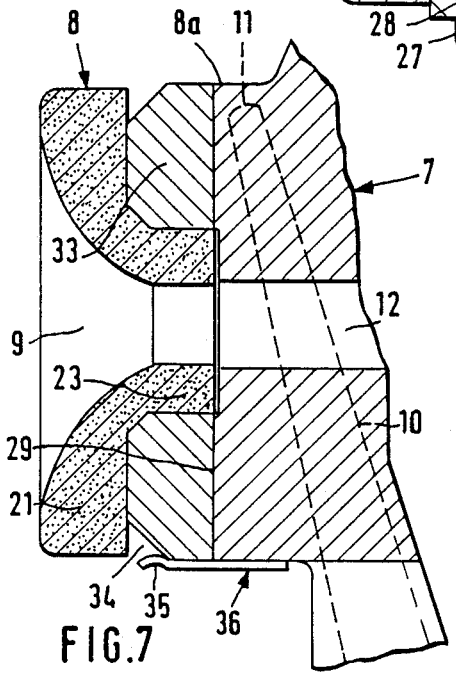
FIG.7
FIG.8
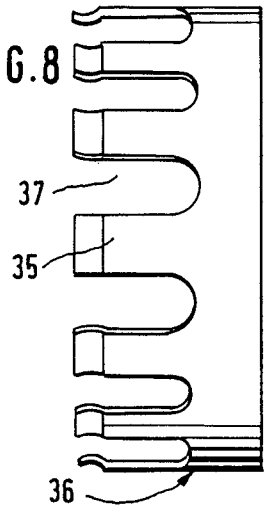

FIG.9
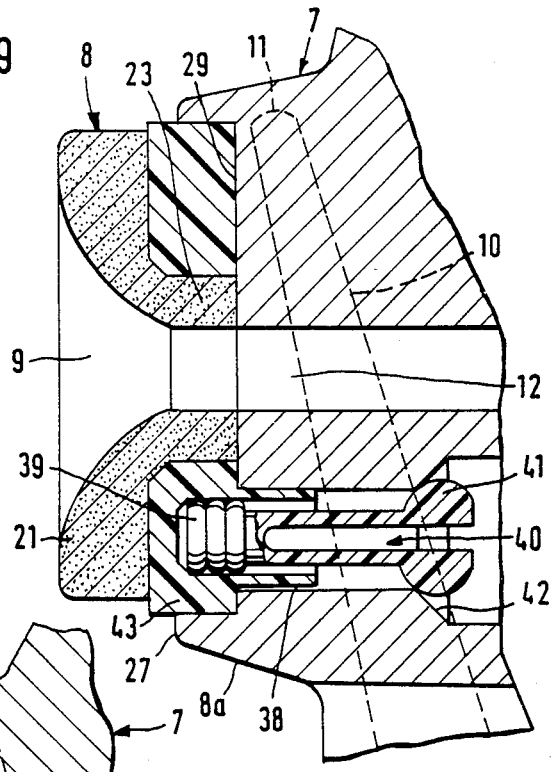
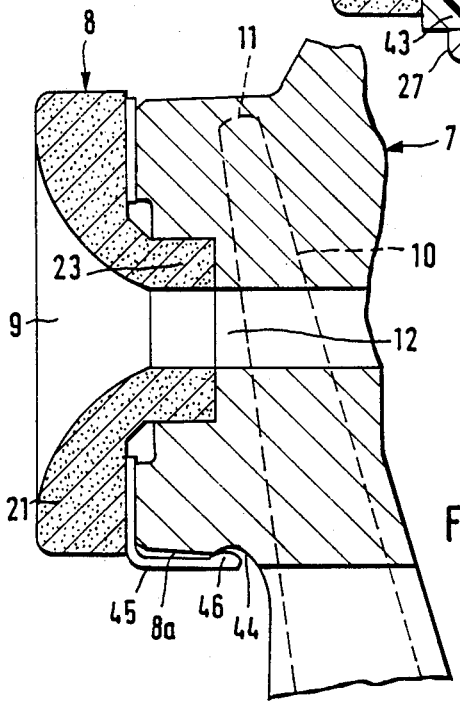
FIG. 10

FIG.11
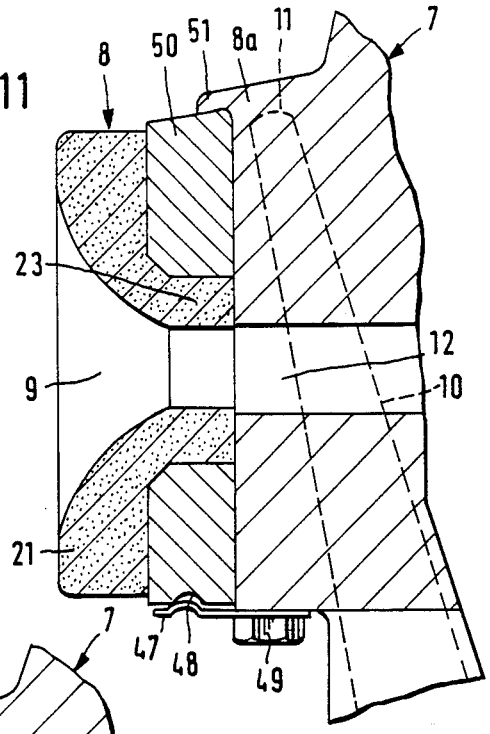
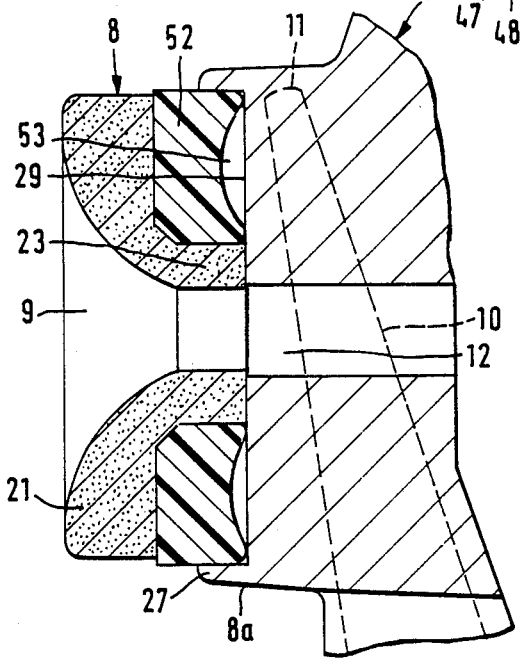
FIG.12

FIG.13
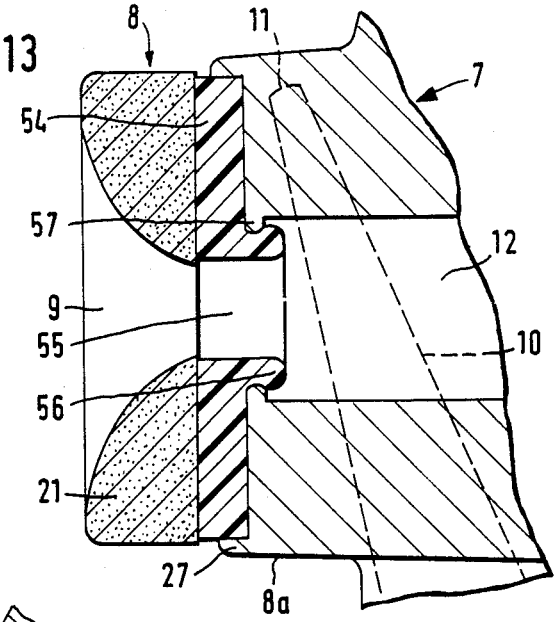
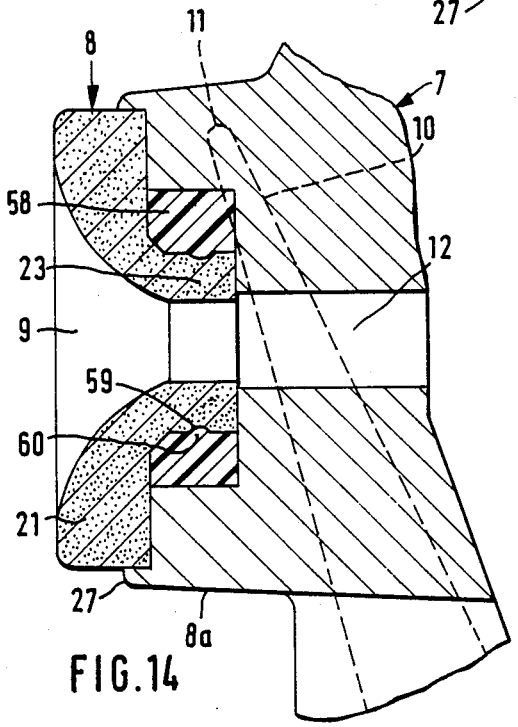
FIG.14
FIG.15
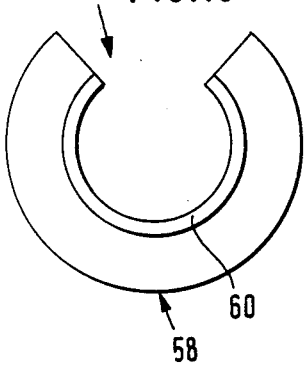

ARRANGEMENT FOR OPEN-END ROTOR SPINNING

BACKGROUND AND SUMMARY OF THE INVENTION

The invention relates to an arrangement for open-end rotor spinning having a spinning rotor, the open side of which is covered by a cover part that is provided with a projection projecting into the spinning rotor, which contains a fiber feeding duct and a yarn withdrawal duct.

A known rotor spinning arrangement is depicted in DE-OS No. 24 55 528 which represents the conventional method of construction of most of today's open-end rotor spinning arrangements. The withdrawal nozzle is made of a wear-resistant material, such as a ceramic material or the like, and is equipped with a thread lug by means of which it is threaded into the projection of the cover part. The fiber feeding duct extends laterally past the yarn withdrawal duct that centrically passes through the projection. In practice, today it is often preferable to use spinning rotors with an increasingly smaller diameter, i.e., rotors having a decreased inside diameter of the fiber collecting groove. Using small spinning rotors of this type that, if necessary, may have a diameter of less than 30 mm, the rotational rotor speed may be increased to more than 100,000 $min^{-1}$. With the diminishing diameter of the spinning rotor, the projection of the cover part that projects into the spinning rotor must naturally also become smaller. Practical problems arise with respect to the housing of both the yarn withdrawal duct and the fiber feeding duct, in which case, particularly the latter cannot be reduced arbitrarily in comparison to the conventional size because the air proportions in the spinning arrangement would no longer be correct.

It is also known (DE-OS No. 27 45 195) to hold a withdrawal nozzle magnetically. In the case of one construction, the withdrawal nozzle is surrounded by an enclosure consisting of a ferromagnetic material and is held magnetically on the end of a hollow shaft that projects into the spinning rotor. The yarn withdrawal takes place through this hollow shaft. In the case of another construction, in which the yarn withdrawal takes place through a cover of the spinning rotor, the withdrawal nozzle is held in a bush consisting of a magnetic material that is inserted into the cover, the withdrawal nozzle being inserted into this bush. Both constructions require space that does not exist at a projection that is to protrude into a spinning rotor that has a very small diameter.

An object of the present invention is to provide a spinning apparatus such that the fiber feeding duct and the yarn withdrawal duct can both be housed in a projection that has a small diameter and a small axial length with respect to the spinning rotor axis.

This object is achieved by fastening a yarn withdrawal nozzle at a cover part by means of a holding element other than the yarn withdrawal nozzle.

Using the present invention, it becomes possible to reduce the space requirement for the withdrawal nozzle, particularly because the withdrawal nozzle no longer has to be screwed into the projection of the cover part by an external thread, i.e. no longer the withdrawal nozzle itself forms the holding element. The withdrawal nozzle may therefore be shorter and also mainly be smaller in its diameter following the inlet area, so that sufficient space exists in the projection in order to house a fiber feeding duct having a relatively large cross-section. The holding element can therefore be constructed and arranged such that it does not limit the existing space.

Other objects, advantages and novel features of the present invention will become apparent from the following detailed description of the invention when considered in conjunction with the accompanying drawings.

BRIEF DESCRIPTION OF THE DRAWINGS

FIG. 6 is a cross-sectional view according to certain preferred embodiments in which the withdrawal nozzle is mounted at a plate;

FIG. 7 is a cross-sectional view according to certain preferred embodiments having a clamping spring as the holding element;

FIG. 8 is a side view of clamping spring according to FIG. 7;

FIG. 9 is a cross-sectional view according to certain preferred embodiments having a clipped-in holding element;

FIG. 10 is a cross-sectional view according to certain preferred embodiments having a clamping spring fastened at the withdrawal nozzle;

FIG. 11 is a cross-sectional view according to certain preferred embodiments having a spring securing device;

FIG. 12 is a cross-sectional view according to certain preferred embodiments including a suction element as the holding element;

FIG. 13 is a cross-sectional view according to certain preferred embodiments having an elastically deformable ring fastened at the withdrawal nozzle;

FIG. 14 is a cross-sectional view according to certain preferred embodiments having a ring-shaped holding element fastened at the cover part and a withdrawal nozzle clipped in the holding element;

FIG. 15 is a schematic end view of the ring-shaped holding element according to FIG. 14;

DETAILED DESCRIPTION OF THE DRAWINGS

Figure 1:
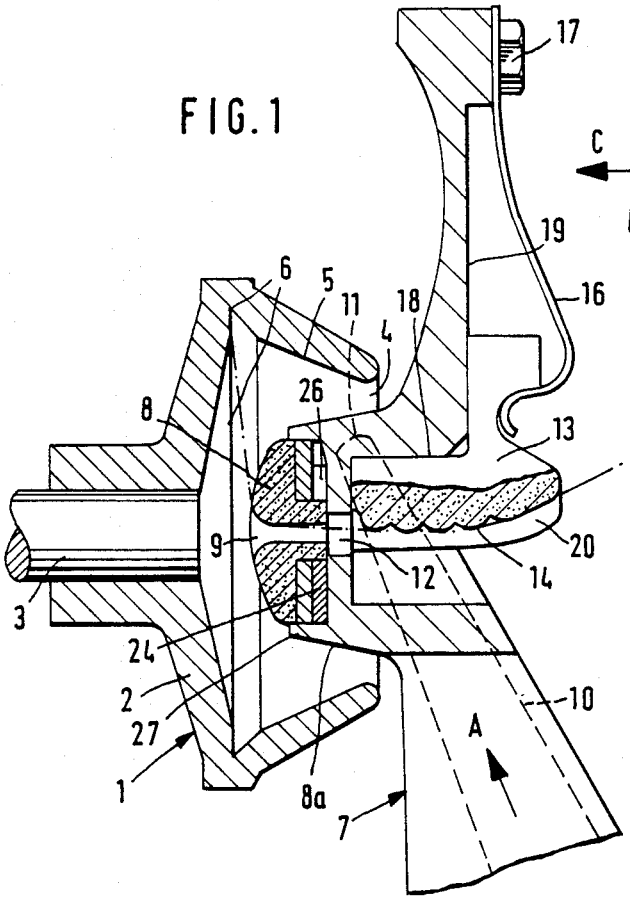
FIG. 1 is a partial cross-sectional view of an arrangement for open-end rotor spinning in the area of the spinning rotor and the holding elements according to certain preferred embodiments of the invention.

In the drawing figures, the spinning rotor 1 and the other components are shown more than twice the actual size.

The spinning rotor 1 includes a rotor 2 arranged on a shaft 3 in a torsionally fixed way. The shaft 3 is disposed and driven in a way that is not shown in detail. The rotor 2 is conventionally arranged in a housing that is not shown and that is connected to a vacuum source. This housing is closed by a cover part 7.

The rotor 2 has an approximately double cone-shaped interior contour. The largest diameter is formed by a fiber collecting groove 6 that is followed by a sliding wall 5 that tapers conically or in a truncated-cone-shaped way with respect to the open edge 4. A projection 8*a* of the cover part 7 protrudes into the rotor 2 and has a slightly conical shape. Between the cover part 7, the projection 8*a*, and the open edge 4 of the rotor 2, is an annular gap, via which the conveying air that conveys fibers into the spinning rotor 1 can flow off.

In the lateral wall of the projection 8*a*, a mouth 11 of a fiber feeding duct 10 is located that tapers in conveying direction A. In a way that is not shown in detail, the fiber feeding duct 10 starts in the area of an opening roller, and separated fibers are fed to the rotor 2 through the duct 10 by means of a conveying air current. The fibers arrive on the sliding wall 5 on which they slide into the collecting groove 6 because of centrifugal force, and in which case they are also drawn. The fibers that are collected in the fiber collecting groove 6 are twisted together into a yarn 15 that is first withdrawn approximately radially and then in axial direction from the rotor 2.

The yarn 15 first moves into an inlet opening 9 of a yarn withdrawal nozzle 8 that narrows in a funnel shape. From the withdrawal nozzle 8, the yarn proceeds through an insert 13 that causes a deflection for the yarn 15 that is withdrawn in the direction of the arrow B by a withdrawal device that is not shown.

Figure 3:
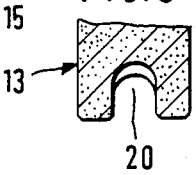
FIG. 3 is a cross-sectional view of an insert that is connected behind a withdrawal nozzle and has false-twisting edges taken in the direction of arrow D in FIG. 1.

As shown in FIG. 1, the withdrawal nozzle 8, forming the starting point of the withdrawal duct, is followed by a bore 12 in the projection 8*a*. The bore 12 has a larger diameter than the passageway through the nozzle 8 so that the spun yarn 15 moves directly from the withdrawal nozzle 8 to the insert 13 without coming in contact with the material of the projection 8*a*. Similar to the withdrawal nozzle 8, the insert 13 is made of a highly wear-resistant material, particularly of a ceramic material. The insert 13 has an approximately semicylindrical guiding groove 20 that is open in downward direction and is provided with false-twisting edges 14 (cross section shown in FIG. 3). These false-twisting edges 14 are sloped in moving direction of the yarn 15 such that they extend approximately in parallel to the slope of the yarn twist. The insert 13 is inserted into a slot-type recess of the cover part 7. The insert is held in the recess by a clamping spring 16 that is screwed onto the cover part 7 by a screw 17. The insert 13 supports itself at two surfaces 18, 19 of the cover part 7 that are perpendicular to one another.

Figure 2:
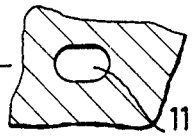
FIG. 2 is a cross-sectional view of a projection of a cover part shown in FIG. 1 in the area of the mouth of a fiber feeding duct taken in the direction of arrow A.

In practice, it is necessary to make a sufficiently large conveying air current flow via the fiber feeding duct 10 so that no flying occurs in the area of the opening roller which is not shown. In order to make this possible and still be able to work with a rotor 2 that is quite small in its dimensions, it is provided that the area of the mouth 11 of the fiber feeding duct 10 has a transversely-oval shape, i.e., the width of the fiber feeding duct 10 in the area of the mouth 11, in circumferential direction of the rotor 2 (direction C of the arrow in FIG. 2), is larger than in axial direction to it. As a result, it is possible to carry out an exactly defined feeding of the fibers, despite a cross section of the fiber feeding duct 10 that is relatively large in comparison to the size of the rotor 2. In such feeding, the arrival point of the fibers is located a sufficient distance from the open edge 4, as well as a sufficient distance from the fiber collecting groove 6.

Figure 5:
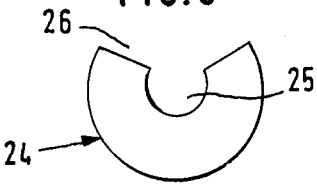
FIG. 5 is a schematic view of the holding magnetic shown in FIG. 1.

In order to be able to dimension the fiber feeding duct 10 without regard to the yarn withdrawal duct 9 and, particularly, the withdrawal nozzle 8, it is provided that the withdrawal nozzle 8 is held at the projection 8*a* magnetically. The front face of the projection 8*a* that faces the bottom of the rotor 2 is provided with a recess that forms a ring web forming an enclosure 27. Within this recess, a permanent magnet is mounted, particularly by gluing, which serves as a holding magnet 24. Advantageously, cobalt samarium is provided for the holding magnet 24. This material permits the manufacturing of efficient magnets with small dimensions. The holding magnet 24 has the shape of a flat annular disk (FIGS. 1 and 5) that includes a cut out over a sector 26 of about 60°. This sector 26 makes it possible to leave a sufficient distance between the mouth area of the fiber feeding duct 10 and the recess at the front face of t he projection 8*a*. The sector 26 is located in the area that is closest to the fiber feeding duct 10.

Figure 4:
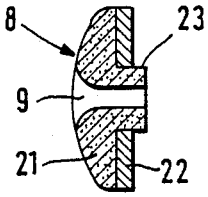
FIG. 4 is a cross-sectional view of a withdrawal nozzle according to certain preferred embodiments.

The withdrawal nozzle 8 is preferably made of a ceramic material in certain preferred embodiments and has an approximately mushroom-shaped design. A head part 21 is provided with an inlet opening 9. A cylindrical part 23 is connected at the head part 21 and is surrounded by a disk 22 made of a ferromagnetic material, particularly a flat steel disk 22 in certain preferred embodiments. The steel disk 22 has the same outer diameter as the head part 21 of the withdrawal nozzle 8. As shown in FIGS. 1 and 4, the cylindrical part 23 of the withdrawal nozzle 8 projects past the disk 22. The cylindrical part 23 is inserted into the center recess 25 of the holding magnet 24. In this embodiment, the withdrawal nozzle 8 is therefore aligned with respect to the holding magnet 24. The bore 12 in the projection 8*a* disposed behind the yarn withdrawal nozzle 8 in yarn withdrawal direction has a larger diameter than the opening through the yarn withdrawal nozzle. Therefore, it is possible to arrange the yarn withdrawal nozzle 8, on the whole, slightly eccentrically with respect to the rotor axis.

In certain other embodiments of the invention, it is provided that the withdrawal nozzle 8 is centered by means of the enclosure 27 of the projection 8*a*.

In the embodiment according to FIG. 6, the head 21 of the withdrawal nozzle 8 is connected with a ring-shaped plate 28 by gluing. The plate 28 has a center recess into which a cylindrical part 23 of the withdrawal nozzle 8 is inserted. The ring-shaped plate 28 is centered in a recess 29 of the projection 8a with respect to the longitudinal axis of the yarn withdrawal duct 12 and is enclosed by a marginal web 27. A bolt-type holding element 30 projects from the plate 28 and may, for example, include a threaded bolt that is screwed into the plate 28. This bolt-type holding element 30 extends in parallel to the yarn withdrawal duct 12, namely at a point that maintains a sufficient distance to the fiber feeding duct 10. Advantageously, the recess for the bolt-type holding element 30 is arranged in such a way that the yarn withdrawal duct 12 is located between the fiber feeding duct 10 and this recess (for reasons of representation, this is not shown in FIG. 6). A nut 31 is screwed onto the end of the bolt-type holding element 30 and fixes the bolt-type holding element 30 and thus the plate 28 and the yarn withdrawal nozzle 8 at the cover part 7.

In the embodiment according to FIG. 7, the withdrawal nozzle 8 is fixed by means of a clamping spring 36 that surrounds the yarn withdrawal nozzle 8 and the projection 8*a* on the outside. The clamping spring 36 is advantageously fastened at the projection 8*a*, for example, by gluing, soldering or welding, or by a threaded pin or the like. The fixing takes place in such a way that the mouth 11 of the fiber feeding duct 10 is not impaired by the clamping spring 36. The clamping spring 36 is formed by individual flexible tongues 35 that project out from a closed ring and includes longitudinal slots 37 that are located in-between the tongues 35 (see FIG. 8).

At the yarn withdrawal nozzle 8, a ring 33 is attached by gluing. As in all other embodiments, the yarn withdrawal nozzle 8 is preferably made of a ceramic material. A flat surface 29 of the ring 33 rests against the front face of the projection 8*a*. The withdrawal nozzle 8 is provided with a projection 23 that penetrates through a central recess of the ring 33 and that, if necessary, is centered by a corresponding recess of the projection 8*a* in radial direction of the yarn withdrawal duct 12 (such as the recess 29 shown in FIG. 6). On the side of the ring 33 that faces the head 21 of the yarn withdrawal nozzle 8, a chamfering is provided so that a notch 34 is formed into which the slightly inwardly bent (cranked) ends of the tongues 35 of the clamping spring 36 engage.

In the embodiment according to FIG. 9, similar to the embodiment according to FIG. 6, the withdrawal nozzle 8 is provided with a ring-shaped plate 43 that has a center recess for a cylindrical projection 23 of the withdrawal nozzle 8. The plate 43 can be made of a plastic material and is glued onto the yarn withdrawal nozzle 8. The plate 43 is centered in a recess 29 of the projection 8*a* of the cover part 7. A pin-type holding element 40 projects from the plate 32 and extends essentially in parallel to the yarn withdrawal duct 12. The pin-type holding element 40 penetrates into a corresponding recess of the projection 8*a*. The pin-shaped holding element 40 includes a bolt that is preferably made of a plastic material and that is inserted into a projection 38 of the plate 43 by means of a holding part 39. The projecting part of the pin-type holding element 40 is provided with at least one longitudinal slot so that it forms a spring element that is flexible in its radial direction. The thickened end 41 reaches behind a widening 42 of the bore of the projection 8*a* in a clip-type way, so that a locking arrangement is created.

In the embodiment according to FIG. 10, the yarn withdrawal nozzle 8 that is made of a ceramic material is inserted directly into a corresponding recess of the projection 8*a* of the cover part 7 by means of a cylindrical projection 23, and in this way is centered with respect to the yarn withdrawal duct 12. On the side of the head part 21 of the withdrawal nozzle 8 facing the projection 8*a*, a clamping spring 45 is mounted that has at least one and preferably several flexible arms that extend in the direction of the projection 8*a*. The clamping spring 45 includes detents 46 which snap into recesses 44 of the projection 8*a*. The clamping springs 45 and the recesses 44 are arranged such that the area of the mouth 11 of the fiber feeding duct 10 is not disturbed.

In the embodiment according to FIG. 11, the rear side of the withdrawal nozzle 8 facing the projection 8*a* is connected firmly with a ring disk 50 that is inserted into a web-type guide 51 of the projection 8*a* such that the withdrawal nozzle 8 is centered with respect to the yarn withdrawal duct 12. The web-type guide 51 surrounds the rings 50 over a large area of the circumference and preferably over at least half of the circumference so that a secure centering is obtained. By means of a screw 49, a clamping spring 47 is fastened at the projection 8*a* and includes a detent which engages in an indentation 48 of the ring 50 and which presses the ring 50 against the guide 51 and secures it in the guide 51.

In the embodiment according to FIG. 12, the side of the withdrawal nozzle 8 facing the projection 8*a* is equipped with a rubber-elastic suction element 52 that is centered in a recess 29 of the projection 8*a*. The rubber-elastic suction element 52 and the bottom of the recess 29 form a closed, annular hollow space 53. When the withdrawal nozzle 8 is inserted, the suction element 52 is deformed so that air escapes from the hollow space 53. After a slight reversing of the elastic deformation, a vacuum is created in the hollow space 53 which secures the withdrawal nozzle 8 at the projection 8*a*.

In the embodiment according to FIG. 13, a head 21 of a withdrawal nozzle 8 is firmly connected with a plastic ring 54 by means of gluing. The plastic ring 54 has a center opening that, in the direction of the projection 8*a*, is enclosed by a toroidal-type web 56. The toroidal web 56 is elastically flexible in radial direction. A collar 57 of the projection 8*a* is assigned to the toroidal web, by which the center opening is slightly narrowed. The toroidal web 56 reaches around the collar 57 in a clipping, locking connection by means of which the withdrawal nozzle 8 is detachably secured at the projection 8*a*.

In the embodiment according to FIGS. 14 and 15, a plastic ring 58 is inserted into the end of the projection 8*a*. The area of the plastic ring 58 that is closest to the fiber feeding duct 10 has a cutout 61 (FIG. 15). This plastic ring 58 is glued into the recess of the projection 8*a*. The withdrawal nozzle 8 is inserted into a recess of the projection 8*a* that is delimited by a ring web 27 and is thus centered with respect to the yarn withdrawal duct 12. A cylindrical projection 23 of the withdrawal nozzle 8 engages in the opening of the ring 58 made of an elastic plastic material. The ring 58 is provided with a surrounding rib 60 to which a corresponding recess 59 of the projection 23 of the withdrawal nozzle 8 is assigned. As a result, a locking connection or a clipping connection is provided between the withdrawal nozzle 8 and the ring 58 fastened at the projection 8*a*.

Figure 16:
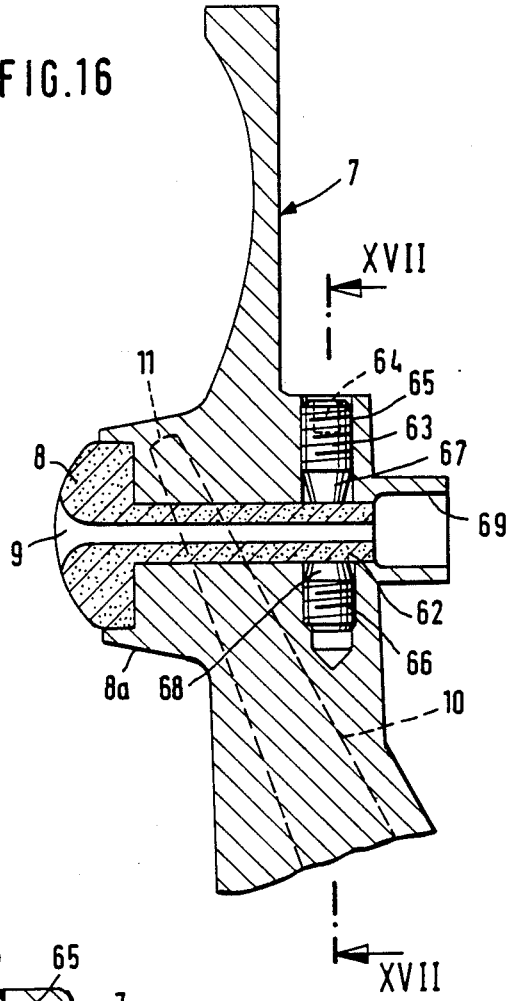
FIG. 16 is a cross-sectional view according to certain preferred embodiments having a threaded bolt as the holding element.
Figure 17:
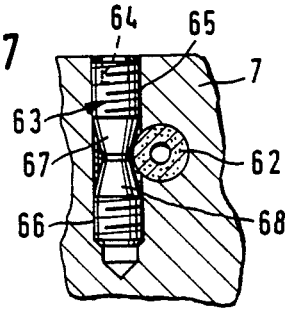
FIG. 17 is a partial cross-sectional view along Line XVII—XVII of FIG. 16.

In the embodiment according to FIGS. 16 and 17, the withdrawal nozzle 8 is provided with a relatively long shaft 62 that extends almost over the whole thickness of the cover part 7. This shaft 62 is followed by a recess 69 in which another guiding element is arranged, such as a yarn withdrawal pipe. The mushroom-type head of the withdrawal nozzle 8 is partially arranged within a recess of the projection 8*a*. The yarn withdrawal nozzle 8 is held in the cover part 7 by a chucking element that is formed by a threaded bolt 63 that is screwed into a threaded bore 65 of the cover part 7. The chucking element can be adjusted transversely with respect to the shaft 62, namely it is screwed in on the outside of the cover, i.e., on the outside that faces away from the spinning rotor that is not shown. As shown in FIG. 17, the threaded bolt 63 has two sections 67 and 68 that taper conically with respect to one another and that each merge into threaded sections 66. The end of the threaded bolt 63 that points to the outside is provided with an internal receiving element 64 for a tool, such as a recessed area for example. As shown in FIG. 17, the threaded bolt 63 is arranged laterally of the shaft 62 such that the shaft 62 is located between the two conical surfaces 67, 68. By adjusting the threaded bolt 63 in one of the other direction starting from its center position, the shaft 62 of the withdrawal nozzle 8 can be braced in the cover part 7.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Open-end rotor spinning apparatus comprising:

spinning rotor means for forming yarn including an open side;

cover means for covering said open-side of said spinning rotor means;

projection means disposed at said cover means for projecting into said open side of said spinning rotor means;

fiber feeding duct means disposed in said projection means for feeding fibers to said spinning rotor means;

yarn withdrawal duct means disposed in said projection means for providing a pathway for formed yarn being withdrawn form said spinning rotor means;

yarn withdrawal nozzle means projecting from said yarn withdrawal duct means into said spinning rotor means open side; and holding means other than said yarn withdrawal duct means for holding said yarn withdrawal nozzle means on said projection means, wherein said spinning rotor means includes a sliding wall for receiving fibers from said fiber feeding duct means, said fiber feeding duct means being provided laterally at said projection means opposite said sliding wall of said spinning rotor means, and wherein said fiber feeding duct means extends across a radial projection of the yarn withdrawal duct means at a first area on said projection means, said holding means being mounted at said cover means in an area outside said first area.

2. Apparatus as in claim 1, wherein said yarn withdrawal duct means is arranged along a longitudinal axis, said holding means being offset with respect to said yarn withdrawal duct means longitudinal axis.

3. Apparatus as in claim 1, wherein said holding means is detachably connectable with said cover means.

4. Apparatus as in claim 1, wherein said holding means is detachably connectable with said yarn withdrawal nozzle means.

5. Apparatus as in claim 1, wherein said cover means includes a guiding means for guiding said yarn withdrawal nozzle means on said cover part into a given position with respect to said yarn withdrawal duct means.

6. Apparatus as in claim 5, wherein said yarn withdrawal duct means is arranged along a longitudinal axis, said yarn withdrawal nozzle means being centered with respect to said longitudinal axis by said guiding means, said holding means securing said withdrawal nozzle means in the direction of said yarn withdrawal duct means longitudinal axis.

7. Apparatus as in claim 6, further including a first magnet mounted on said projection means on a section facing into said spinning rotor means and including a ferromagnetic element mounted at said yarn withdrawal nozzle means assigned to said first magnetic, said first magnet and said ferromagnetic element interacting in a first direction, said guiding means aligning said yarn withdrawal nozzle means in a direction transverse to said first direction.

8. Apparatus as in claim 7, wherein said first magnet and said ferromagnetic element are flat and disc-shaped.

9. Apparatus as in claim 8, wherein said first magnet includes a recess and said yarn withdrawal nozzle means includes a projecting part which is insertable into said recess of said first magnet.

10. Apparatus as in claim 9, wherein said projection further includes an enclosure surrounding at least a portion of said yarn withdrawal nozzle means.

11. Apparatus as in claim 7, wherein said first magnet is ring-shaped and includes a recessed area in an area where said fiber feeding duct means crosses by said first magnet.

12. Apparatus as in claim 7, wherein said yarn withdrawal nozzle means includes a mushroom-shaped head and said projecting part includes a cylindrical section extending from said mushroom-shaped head, said first magnetic including a center aperture in a ring shape through which said cylindrical section is engaged.

13. Apparatus as in claim 12, wherein said ferromagnetic element is ring-shaped and said cylindrical section of said yarn withdrawal nozzle means is surrounded by said ring-shaped ferromagnetic element.

14. Apparatus as in claim 1, wherein said holding means includes a plate surrounding said yarn withdrawal nozzle means and a pin-type holding element connected to said plate, said cover means including a receiving bore, said pin-type holding element extending. essentially parallel to said yarn withdrawal duct means and being mounted and secured in said cover means receiving bore.

15. Apparatus as in claim 14, wherein said pin-type holding element includes an end nearest said plate and includes an end opposite said plate provided with threads.

16. Apparatus as in claim 14, wherein said pin-type holding element includes at least one locking element end for locking into at least one of said plate and said cover means.

17. Apparatus as in claim 16, wherein said locking element comprises a snap locking element including a spring element flexible in a radial direction of said pin-type holding element.

18. Apparatus as in claim 1, wherein said holding means includes a clamp-type holding element for clamping said yarn withdrawal nozzle means to said cover means.

19. Apparatus as in claim 18, wherein said projection means includes at least one recess on an outer circumference, said clamp-type holding element being attached to said yarn withdrawal nozzle means and including at least one locking means for reaching around said projection means and engaging into said at least one projection means recess.

20. Apparatus as in claim 18, wherein said yarn withdrawal nozzle means includes at least one recess, said clamp-type holding element being attached to said projection means and including at least one locking means for engaging into said at least one yarn withdrawal nozzle means recess.

21. Apparatus as in claim 18, further including a locking component firmly attached to said yarn withdrawal nozzle means, said locking component including at least one recess on an outer circumference, said clamp-type holding element being attached to said projection means and including at least one flexible locking means for engaging into said at least one locking component recess.

22. Apparatus as in claim 1, wherein said projection means includes at least one recess, said holding means including an elastic ring means mounted firmly on said yarn withdrawal nozzle means for engaging into said at least one projection means recess, said elastic ring means being elastically deformable in a radial direction of said elastic ring means.

23. Apparatus as in claim 1, wherein said yarn withdrawal nozzle means includes at least one recess, said holding means including an elastic ring means mounted firmly on said projection means for engaging into said at least one yarn withdrawal nozzle means recess, said elastic ring means being elastically deformable in a radial direction of said elastic ring means.

24. Apparatus as in claim 23, wherein said elastic ring means includes a recessed area in an area where said fiber feeding duct means passes by said elastic ring means.

25. Apparatus as in claim 1, wherein said holding means includes a suction element for holding said yarn withdrawal nozzle means at said projection means.

26. Apparatus as in claim 1, wherein said holding means includes a chucking element for holding said yarn withdrawal nozzle means in said projection means.

27. Apparatus as in claim 26, wherein said yarn withdrawal nozzle means includes an elongated shaft being guided into said cover means, said chucking element being adjustable transversely to said shaft.

28. Apparatus as in claim 27, wherein said chucking element is disposed in an area outside said cover means covering said spinning rotor means, said shaft extending beyond said projection means and being clamped by said chucking element in said area outside said cover means.

29. Apparatus as in claim 27, wherein said chucking element includes at least one threaded bolt adjustable essentially transversely to said yarn withdrawal duct means.

30. Apparatus as in claim 29, wherein said threaded bolt includes a central area in between two end threaded areas, said central area including a section conically tapered inwardly from each end threaded area, said shaft being disposed on the circumference of said threaded bolt adjacent said central area.

31. Apparatus as in claim 1, further including an insert extending from said yarn withdrawal nozzle means, said insert including at least one false-twisting edge for deflecting the formed yarn being withdrawn.

32. Apparatus as in claim 1, wherein said fiber feeding duct includes a mouth area, said spinning rotor means sliding wall including a circumferential component, said mouth area being wider in said circumferential direction than in axial direction of said spinning rotor means.

33. Apparatus as in claim 1, wherein the spinning rotor means has a diameter no greater than 30 millimeters.

* * * * *